US006370720B1

(12) United States Patent
Jang

(10) Patent No.: US 6,370,720 B1
(45) Date of Patent: Apr. 16, 2002

(54) APPARATUS AND A METHOD FOR AUTOMATICALLY ERASING A BLACKBOARD

(76) Inventor: Chang-ho Jang, 210-1203, Hanbomido Mansion, Daechi-dong 511, Kangnam-gu, Seoul, 135-280 (KR)

( * ) Notice: Subject to any disclaimer, the term of this patent is extended or adjusted under 35 U.S.C. 154(b) by 0 days.

(21) Appl. No.: 09/288,141

(22) Filed: Apr. 8, 1999

(30) Foreign Application Priority Data

Apr. 10, 1998 (KR) ..... 98-12841
Jan. 21, 1999 (KR) ..... 99-1847

(51) Int. Cl.[7] ..... A47L 11/38

(52) U.S. Cl. ..... 15/98; 15/97.1; 15/246; 434/417

(58) Field of Search ..... 15/97.1, 98, 246; 434/417, 411

(56) References Cited

U.S. PATENT DOCUMENTS 3,858,265 A 1/1975 Schlick
4,742,594 A 5/1988 Chen
4,941,225 A * 7/1990 Liao ..... 15/98
5,216,776 A 6/1993 Dennison
5,319,820 A 6/1994 Forst
6,073,297 A * 6/2000 Lee ..... 15/102
6,266,841 B1 * 7/2001 Cho ..... 15/246

* cited by examiner

*Primary Examiner*—Randall E. Chin
(74) *Attorney, Agent, or Firm*—Reed Smith LLP

(57) ABSTRACT

An automatic blackboard erasing apparatus reciprocates, or moves back and forth, horizontally on a blackboard. The automatic blackboard erasing apparatus incorporates a housing, right and left erasing elements each having one or more brushes and one or more wiper members, a variable contact element for controlling the contact state of the erasing elements relative to the blackboard, a washing liquid supplier for providing washing liquid between the brushes and the surface of the blackboard, and a controller for controlling the operation of the erasing apparatus. When the erasing apparatus traverses to the right of the blackboard to erase the blackboard, the left erasing element is in contact with the blackboard, and the right erasing element is not in contact with the blackboard. When the erasing apparatus traverses to the left of the blackboard to erase the blackboard, the right erasing element is in contact with the blackboard.

9 Claims, 19 Drawing Sheets

APPARATUS AND A METHOD FOR AUTOMATICALLY ERASING A BLACKBOARD

BACKGROUND OF THE INVENTION

1. Field of the Invention

This invention relates to an apparatus and a method for automatically erasing a blackboard, and more particularly, to an improved apparatus and method for automatically erasing the blackboard wherein the automatic erasing apparatus horizontally reciprocates (or moves back and forth) relative to a blackboard.

2. The Background Art

In general, a stuffed eraser made of fabrics is usually used in order to erase characters written on a conventional blackboard. However, when erasing the blackboard with a stuffed eraser, the user's respiratory system and/or nasal mucous membranes may be threatened by the chalk dust in the air. The chalk dust also pollutes and dirties the surroundings of the chalkboard.

There is another disadvantage in that the user must physically shake the chalk dust from the eraser after each erasing operation.

There is a further disadvantage in that, since the surface of the blackboard has a prescribed roughness to prevent sliding of the chalk, when the user writes characters on the blackboard with the chalk, chalk particles become embedded in minute concave portions of the surface of the blackboard, so that the fabric eraser cannot completely and clearly erase the characters on the surface of the blackboard, and blurry traces from the erased characters remain on the board.

In order to solve these problems of the prior art, numerous types of automatic erasing apparatuses have previously been proposed. Certain of these known automatic erasing apparatuses are disclosed in Japanese patent publication numbers 8-113000 and 9-193599. Each of these proposed automatic erasing apparatuses is for automatically erasing a blackboard. These automatic erasing apparatuses are operated as follows:

(a) spraying washing liquid on a surface of a blackboard through a first nozzle to dissolve a film layer of chalk attached on the blackboard;

(b) rotating an erasing member such as a brush or a sponge in engagement with the surface of the blackboard to isolate the dissolved chalk from the surface of the blackboard;

(c) again spraying the washing liquid on the surface of the blackboard trough a second nozzle to wash down the dissolved chalk;

(d) temporarily storing the used liquid containing the dissolved chalk in a tank to settle down the fine particles of the chalk;

(e) filtering and pumping up the washing liquid to return it to the tank in order to reuse it;

(f) scrubbing the liquid remaining on the surface of the blackboard with a rubber scrubber in engagement with the blackboard and drying the blackboard with hot air.

The erasing apparatuses illustrated in JP 8-113000 and JP 9-193599 both reciprocate laterally of the elongated blackboard. An eraser member of the erasing apparatus traverses in engagement with the surface of the blackboard during the erasing operation, and traverses in disengagement with the surface of the blackboard when returning to its original position.

However, the previously proposed automatic erasing apparatuses also have several disadvantages which are generally recognized in use. A user must wait until the erasing apparatus finishes one complete operation, i.e., returns to its original position after erasing the blackboard, so it is very inconvenient and is a waste of time.

Moreover, the erasing apparatus in the prior art automatic devices has a decreased lifetime because the erasing apparatus returns to its original position after finishing the erasing operation without being used during its return.

In addition, in the prior art automatic devices, the erasing apparatus cannot erase only a portion of the blackboard (for example, half of the blackboard), because it is fixed to perform the reciprocation relative to the entire blackboard once operation of the erasing apparatus begins.

SUMMARY OF THE INVENTION

It is accordingly an object of this invention to provide an improved apparatus and method for automatically erasing a blackboard with an erasing device which overcomes the above disadvantages.

Another object of this invention is to provide an apparatus and a method for automatically erasing a blackboard with an erasing device which reciprocates relative to a blackboard to perform an erasing operation not only while traversing forwardly but also while returning to its original position, thereby providing a cleaner surface of the blackboard.

A further object of this invention is to provide an apparatus and a method for automatically erasing a blackboard with an erasing device which may erase or clean a selected portion of the blackboard as well as the entire surface of the blackboard according to the user's needs, thereby improving convenience to the user.

The foregoing and other objects and features of the present invention will become more fully apparent to persons of ordinary skill in the art from the following description and appended claims, taken in conjunction with the accompanying drawings.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which.

DETAILED DESCRIPTION OF THE PREFERRED EMBODIMENTS

Figure 1:
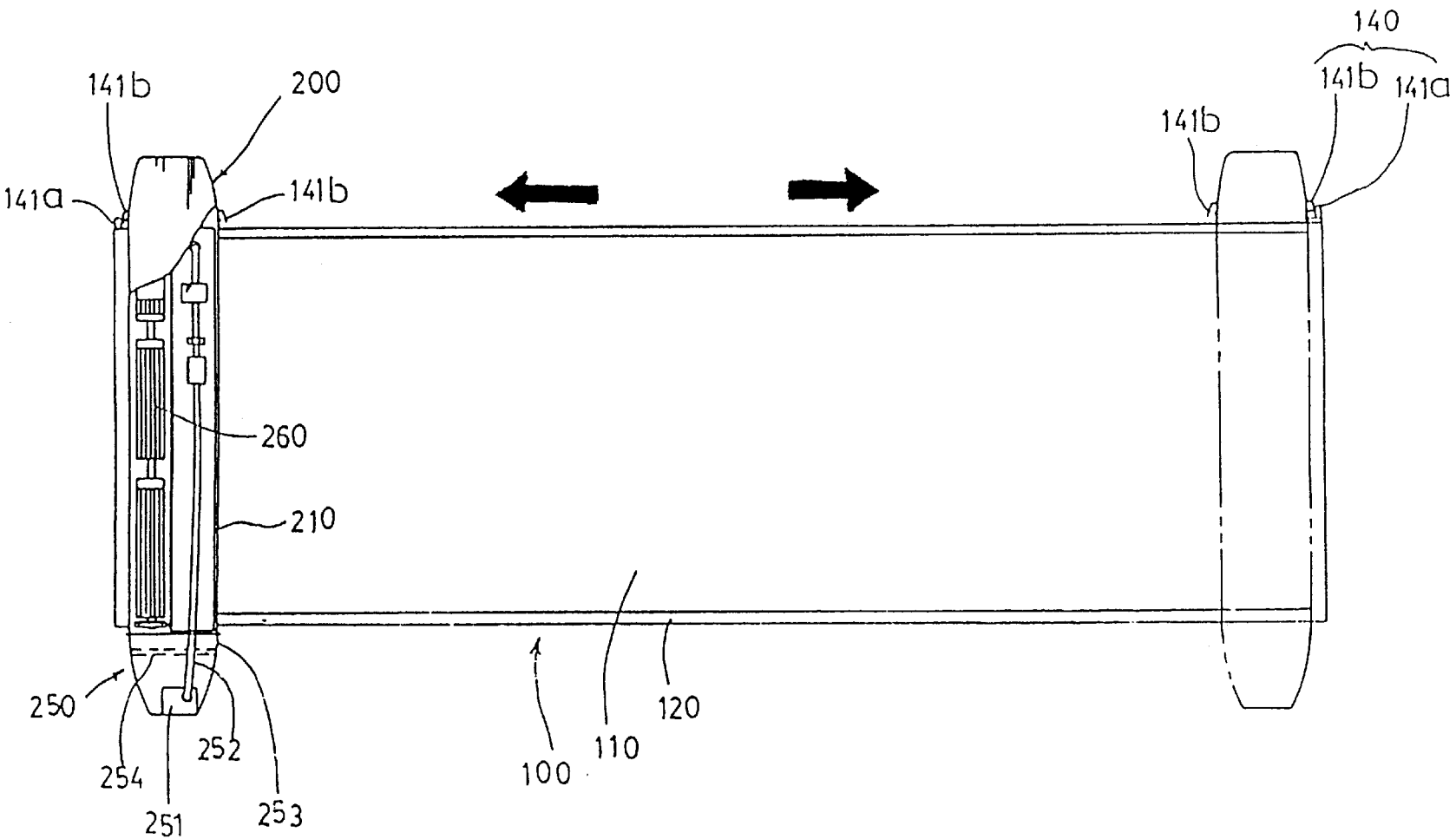
FIG. 1 is a front view showing the outline of an erasing device mounted on a blackboard according to a preferred embodiment of the present invention.

It will be readily understood that the components and steps of the present invention, as generally described and illustrated in the figures herein and accompanying text, could be arranged and designed in a wide variety of different configurations while still utilizing the inventive concept. Thus, the following more detailed description of the preferred embodiments of the system and method of the present invention is not intended to limit the scope of the invention, as claimed, but it is merely representative of the presently preferred embodiments of the invention.

The presently preferred embodiments of the invention will be best understood by reference to the drawings, wherein like parts or steps are designated by like numerals throughout.

Referring now to the drawings, and in particular to FIGS. 1 to 17 thereof, an improved apparatus and method for automatically erasing a blackboard is illustrated. The automatic erasing apparatus essentially comprises a board body 100 having a blackboard plate 110 made of steel or synthetic resin and a board frame 120 enclosing the contour of the blackboard plate 110 to protect the blackboard plate 110, and an erasing device 200 mounted to an upper frame of the board frame 120 for reciprocation (moving back and forth) relative to a surface of the blackboard plate 110.

In order to guide the lateral reciprocation of the erasing device 200, moving guiding means 130 is mounted on the blackboard frame 120 and the erasing device 200. The moving guiding means has a rack gear 131*a* and a pinion gear 131*b*. The rack gear 131*a* is horizontally positioned along the upper frame of the blackboard frame 120 and the. pinion gear 131*b* is mounted to the erasing device 200 to engage to the rack gear 131*a*. It will be appreciated that other equivalent types of guiding means can be used, for example, a roller chain and a chain sprocket in place of the rack gear 131*a* and the pinion gear 131*b*.

Figure 2:
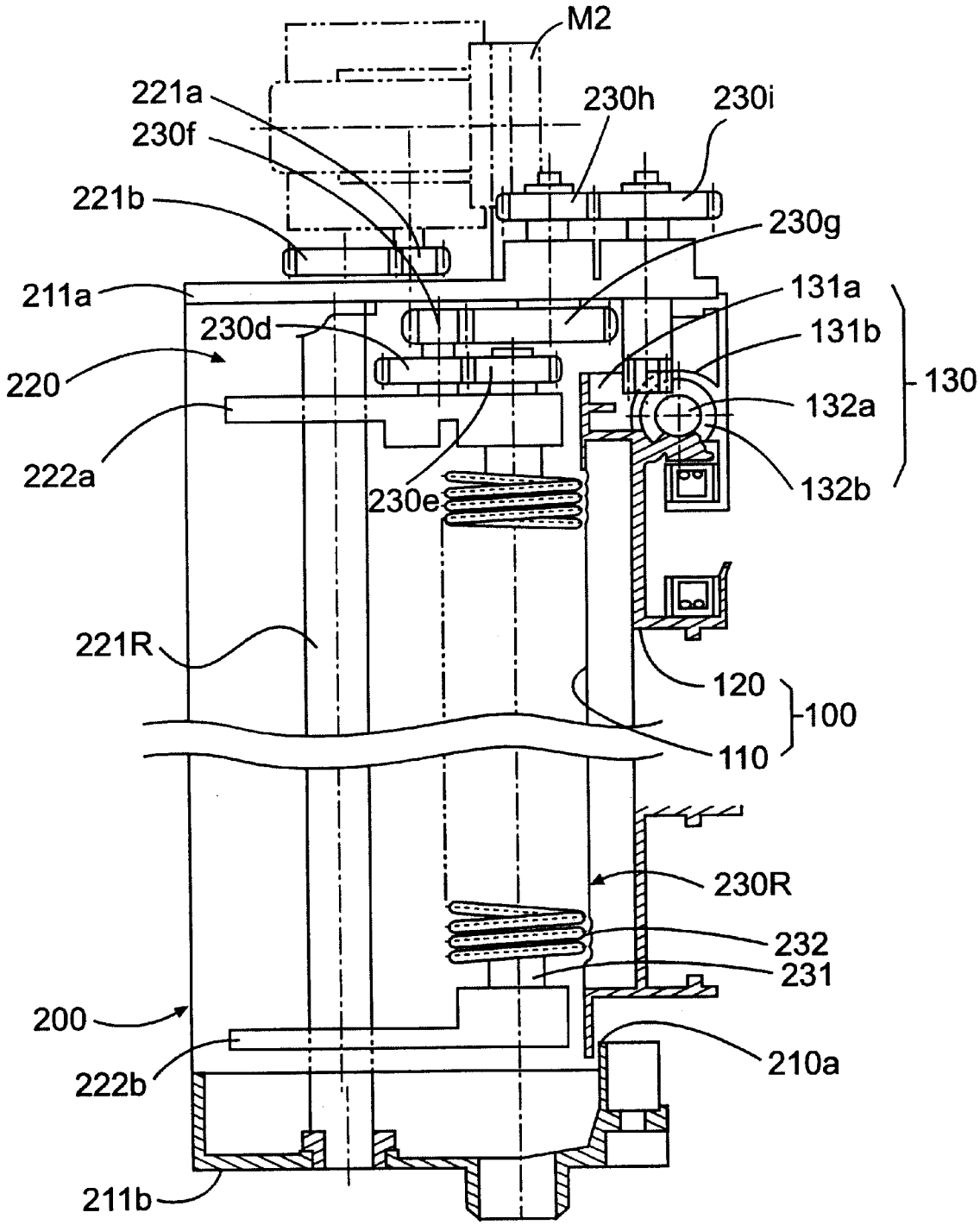
FIG. 2 is a vertical sectional view taken from the right direction against variable contact means and moving guiding means according to the preferred embodiment of the present invention.

In FIG. 2, the reference numeral 132*a* indicates a guide rod extending in the lateral direction of the board body 100, and the reference numeral 132*b* indicates a bearing for supporting the guide rod 132*a* and for maintaining the smooth reciprocation of the erasing device 200 relative to the blackboard plate 110.

The erasing device 200 requires a position sensor 140 to control the run of the erasing device 200 so as not to deviate during traversing from one end to the other end of the blackboard. The position sensor 140 includes two contact members 141*a* positioned at opposing end portions of the upper frame of the blackboard frame 120 and two limit switches 141*b* positioned at opposing end portions of the erasing device 200. In the present invention, the limit switches 141*b* are adapted as a means for sensing the position. However, other proper means of sensing known to those skilled in the art, for example, a proximity sensor or a timer, may be used to limit the reciprocation of the erasing device 200.

FIGS. 1 to 8 show a preferred embodiment of the present invention.

The erasing device 200 embodied herein includes: a housing 210 having an opening portion toward the blackboard plate 110, and an upper support plate 211*a* and a lower support plate 211*b* which are fixed to walls of the housing 210; right erasing means R having a right cylindrical brush 230R and two right wiper members 240R; left erasing means having a left cylindrical brush 230L and two left wiper members 240L, one of the erasing means R and L contacting the blackboard plate 110 during traverse of the erasing device 200 according to the movement direction of the erasing device 200; variable contact means 220 for determining the contact state of the right and left erasing means R and L with respect to the surface of the blackboard plate 110; a washing liquid supplier 250 for supplying washing liquid to erase the used surface of the blackboard plate 110; and a forced drier 260 for drying the surface of the blackboard plate 110 moistened by washing liquid.

The cylindrical brushes 230R and 230L, together embodying the brush element 232, have bristles which are about 10 mm or less in length and have rotating speeds of about 200 r.p.m to 300 r.p.m. This has a particular advantage since the rotating brushes 230R and 230L provide effective erasure of chalk dust while having a self-cleaning capability because the polluted liquid contained in the brushes 230R and 230L is naturally removed outwardly due to centrifugal force which occurs during the rotation of the brushes 230R and 230L.

Each of the wiper members 240R and 240L comprises rubber blades having a narrow front end portion. Since the wiper members 240R and 240L of this invention are always getting wet with the washing liquid, and traverse the blackboard plate 110 in engagement with the blackboard plate 110 during erasing of the blackboard plate 110, the wiper members 240R and 240L require excellent water-resistance and abrasion-resistance. In order to improve water-resistance and abrasion-resistance of the wiper members 240R and 240L and to prolong the useful life, it is preferable that the front end portions of the wiper members to be in contact with the blackboard plate 110 are treated with halogen and coated with a thin film made of synthetic resin polymer such as polychloroethylene or polyurethane. By virtue of lubrication of the thin film, the wiper members 240R and 240L may smoothly reciprocate relative to the blackboard plate 110 and wipe the used liquid remaining on the blackboard plate 110 entirely off.

Two pairs of the erasing means R and L consisting of the brush and the wiper members oppose the surface of the blackboard plate 110 and are arranged oppositely from each other. That is, the right and left brushes 230R and 230L are arranged in the middle, two right wiper members are arranged at right side portion of the right brush 230R and two left wiper members 240L are arranged at left side portion of the left brush 230L.

The erasing means according to the present invention operates as follows: Firstly, the brush traverses the blackboard plate in engagement with the blackboard plate to erase the chalk dust on the blackboard plate, and then, the wiper members follow the brush in engagement with the blackboard plate to wipe the used washing liquid remaining on the blackboard plate. In order to ensure the erasing operation of the erasing means when the erasing device 200 returns to its original position, the position of the brush and the wiper member has to be changed. In order to satisfy this condition, as described above, two pairs of the erasing means including the brush and the wiper members are arranged opposite to each other, and the variable contact means 220 is adopted as means to permit the erasing means to contact the blackboard surface.

The variable contact means 220 comprises: right and left eccentric axles 221R and 221L rotatably mounted between the upper support plate 211*a* and the lower support plate 211*b;* upper and lower rectangular variable plates 222*a* and 222*b* having a round hole through which the right eccentric axle is perforated; and an elliptical hole through which the left eccentric axle is perforated, a first cover member 225 vertically mounted between the upper variable plate 222*a* and the lower variable plate 222*b* and covering the eccentric axles 221R and 221L; and a second cover member 226 vertically mounted between the upper variable plate 222*a* and the lower variable plate 222*b* and having two protrusions 227 protruding outwardly from both front end portions 226*a* of the second cover member 226.

Two pairs of the erasing means R and L are covered with the second cover member 226 having an omega (ω) shape. The second cover member 226 has two arc shaped covering portions 226*b* which are larger in diameter than the brushes 230R and 230L and cover the brushes 230L and 230R with their internal walls. Each of the protrusions 227 of the second cover member 226 has two holes 227*a* into which the wiper members 240R and 240L are placed. The covering portions 226*b* and the holes 227*a* of the second cover member 226 have a length similar to that of the cylindrical brushes 230R and 230L and the wiper members 240R and 240L. The arc shaped covering portions 226*b* covering the brushes 230R and 230L cause the washing liquid to spin during washing or erasing of the blackboard plate 110, thereby increasing the cleaning effect.

The eccentric axles 221L and 221R are vertically mounted on the upper and lower variable plates 222*a* and 222*b* at the rear of the second cover member 226, and the upper and lower shafts 231 of the brushes 230R and 230L are also mounted on the upper and lower variable plates 222*a* and 222*b*. Therefore, when the eccentric axles 221R and 221L are rotated in one direction, the variable plates 222*a* and 222*b* connected to the shafts 231 of the brushes 230R and 230L are moved in the right direction or in the left direction to contact or not to contact the brushes 230R or 230L relative to the blackboard plate 110.

A first motor M1 for providing drive power to the brushes 230R and 230L is drivingly interconnected to the upper variable plate 222*a*. The drive power from the first motor M1 is transmitted to a gear 230*a* which is drivingly interconnected with the upper variable plate 222*a*. The drive power transmitted to the gear 230*a* is transmitted to the brushes 230R and 230L through a first intermediate gear 230*b,* a first pinion gear 230*c,* a second intermediate gear 230*d,* and a second pinion gear 230*e*. Shafts of the gears 230*a* to 230*e* are all drivingly interconnected to the upper variable plate 222*a*.

A gear 230*f* is mounted on the same shaft of the second intermediate gear 230*d*. The gear 230*f* is a medium to induce the drive power from the first motor M1 for lateral reciprocation of the erasing device 200 relative to the blackboard plate 110. That is, the drive power to drive the brushes 230R and 230L is transmitted to a gear 230*g* through the second intermediate gear 230*d* and the gear 230*f*. The drive power transmitted to the gear 230*g* is transmitted to the pinion gear 131*b* through gear 230*h* mounted on the same shaft of the gear 230*g* and a gear 230*i* that meshes with the gear 230*h* and is mounted on the same shaft of the pinion gear 131*b*. As previously described, the pinion gear 131*b* meshes with the rack gear 131*a* positioned along the upper frame of the blackboard frame 120 in order to guide the lateral reciprocation of the erasing device 200 relative to the blackboard plate 110.

The eccentric axles 221L and 221R are driven by drive power from a second motor M2. That is, the rotation of the eccentric axles 221R and 221L occurs when drive power from the motor M2 is transmitted to the eccentric axles 221L and 221R through a gear 221*a,* a pinion gear 221*b,* a first intermediate gear 221*c,* and a pinion gear 221*d*. The eccentric axles 221R and 221L are drivingly connected to shafts of the pinion gears 221*b* and 221*d* which mesh with each other, the pinion gears 221*b* and 221*d* being equal in size and rotation direction.

The gears 230*f* and 230*g* are mounted beneath the upper support plate 211*a,* and the gears 230*h* and 230*i* are mounted on the upper support plate 211*a*.

The upper support plate 211*a* is provided to prevent the washing liquid from entering the upper portion in which the power transmission system is mounted.

In order to determine the contact position of the erasing means R or L with respect to the blackboard plate 110, a sense element 221*e* is fixed on an upper edge of the pinion gear 221*b* by a bracket, and three proximity sensors 221*f* are mounted on the upper support plate 211*a* to sense the location of the sense element 221*e*.

Figure 3:
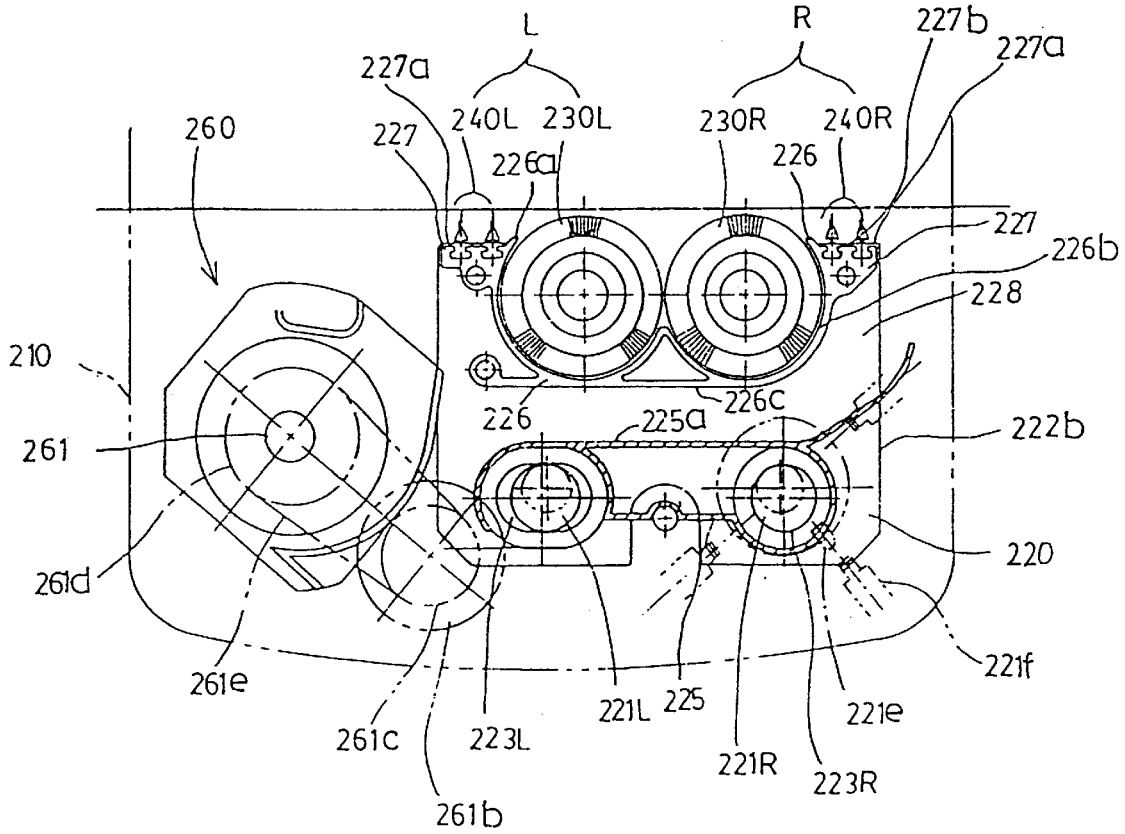
FIG. 3 is a transverse cross sectional view showing the inside structure of the preferred embodiment of the present invention.

In FIG. 3, when a first sensor 221*f* positioned at right in the drawing senses the sense element 221*e,* the right erasing means R contacts the blackboard plate 110. When the right erasing means R traverses in the left direction in engagement with the blackboard plate 110, the left erasing means L also traverses to the left direction out of engagement with the blackboard plate 110 (referred to as "the right contact state of the erasers").

When a second sensor 221*f* senses the sense element 221*e,* the right and left erasing means R and L are both in a noncontact state relative to the blackboard plate 110 (referred to as "the neutral state of the erasers").

When a third sensor 221*f* senses the sense element 221*e,* the left erasing means L contacts the blackboard plate 110. When the left erasing means L traverses in the right direction in engagement with the blackboard plate 110, the right erasing means R also traverses to the right direction out of engagement with the blackboard plate 110 (referred to as "the left contact state of the erasers").

Figure 5A:
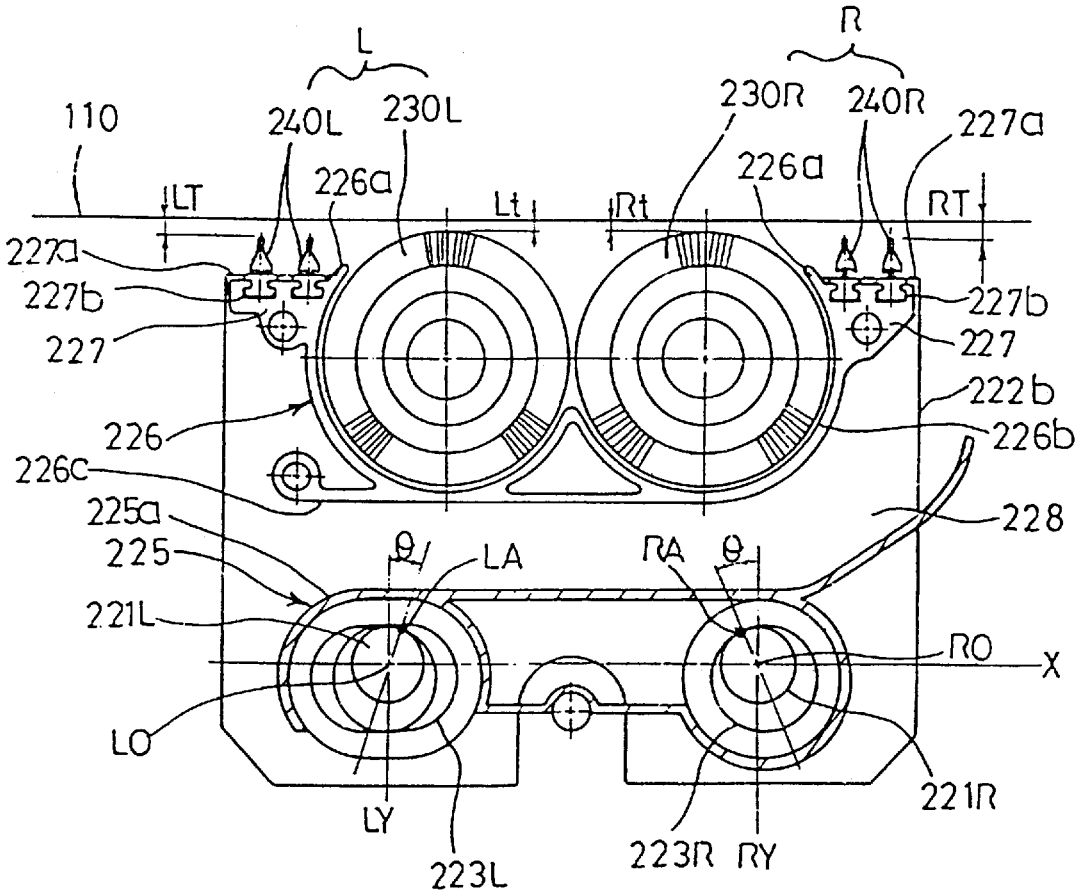
FIGS. 5*a* to 5*c* are plan views showing the operating principle of the variable contact means according to the preferred embodiment of the present invention.
Figure 5B:
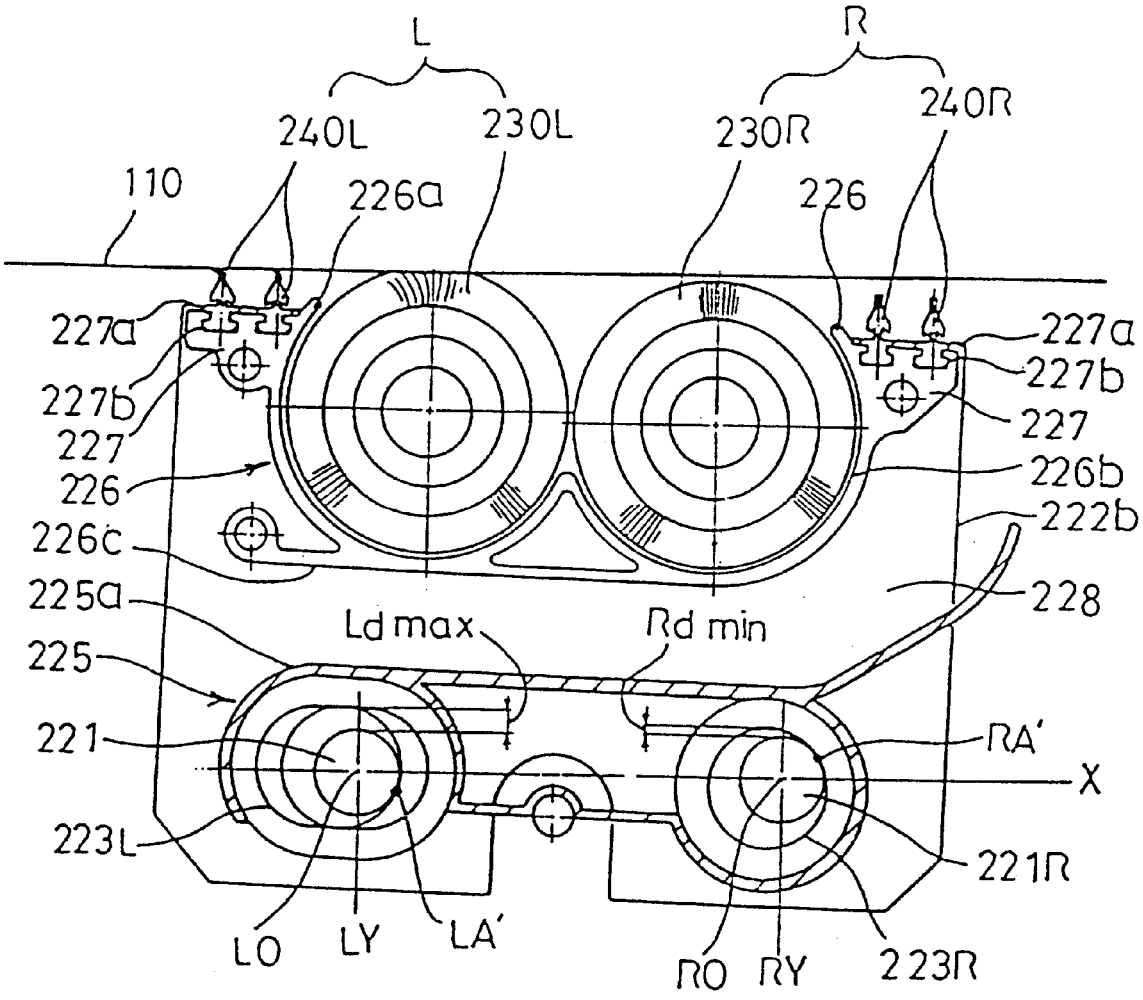
Figure 5C:
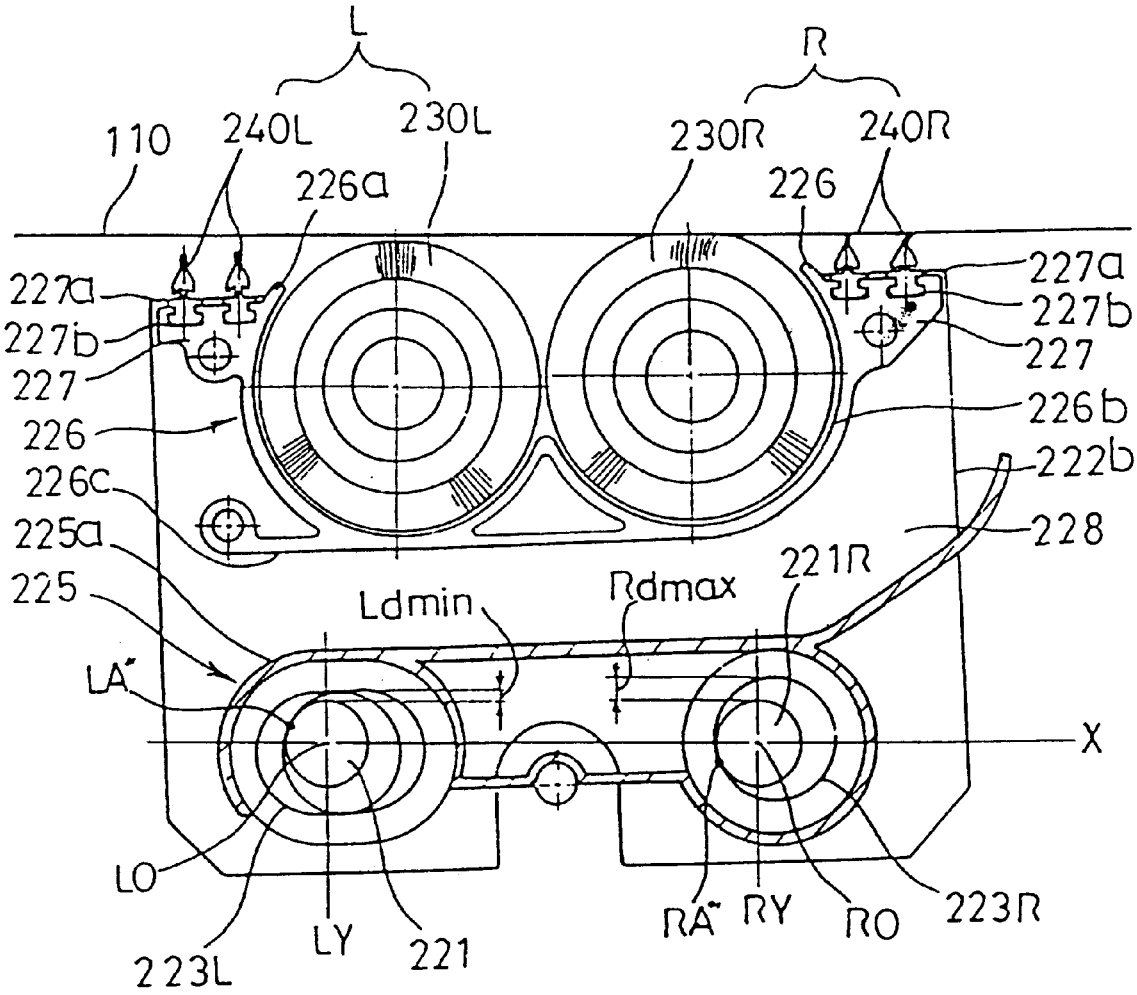
Figure 6:
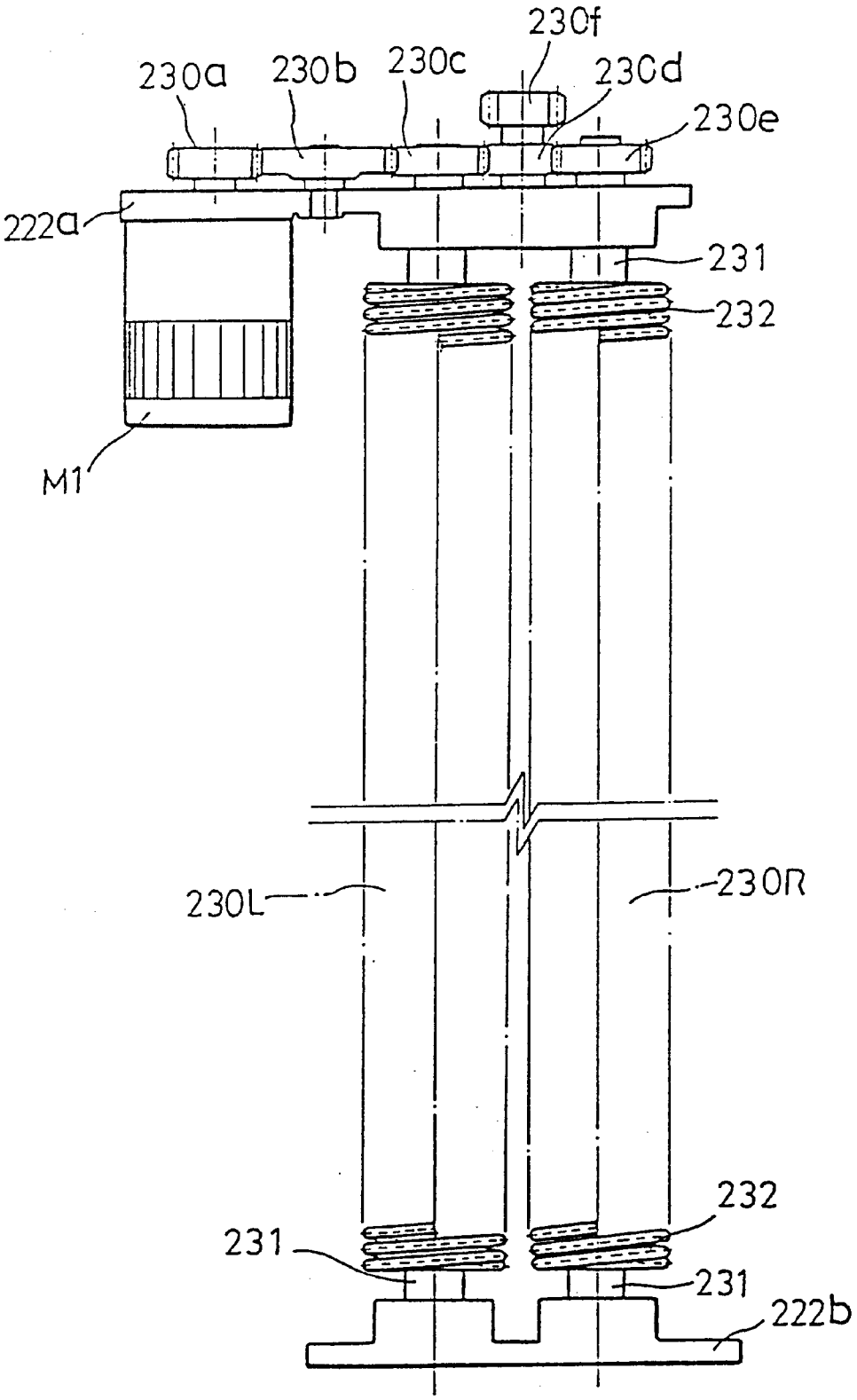
FIG. 6 is a vertical sectional view taken from the front direction against the variable contact means and right and left brushes according to the preferred embodiment of the present invention.

Referring to FIGS. 5*a* to 5*c*, the contact states of the erasing means R and L relative to the blackboard plate 110 will now be described in more detail.

The right and left eccentric axles 221R and 221L are symmetric relative to each other. When the left erasing means L traverses in the right direction in engagement with the blackboard plate 110 to erase the blackboard plate 110, the eccentric axles 221R and 221L rotate in the clockwise direction, and when the right erasing means R traverses in the left direction in engagement with the blackboard plate 110, the eccentric axles 221R and 221L rotate in the counterclockwise direction.

FIG. 5*a* illustrates the neutral state of the erasers.

In FIG. 5*a*, the reference A ("R" referring to "right" and "L" referring to "left") indicates a displacement start point of the eccentric axles 221R and 221L, and the reference O (with "R" and "L" as above) indicates an axis center point of an inner diameter of the eccentric axles 221L and 221R.

As shown in FIG. 5*a*, in the neutral state, the brushes 230R and 230L are both out of engagement with the blackboard plate 110 at (t) interval ("Rt" and "Lt"), and the wiper members 240R and 240L are out of engagement with the blackboard plate 110 at (T) interval ("RT" and "LT"). The ratio of the intervals (t) to (T) is one to two, i.e., the intervals (t) and (T) have the following relationship.

$$LT(RT)=2\cdot Lt(Rt)$$

FIG. 5*b* illustrates the left contact state of the erasing means. In this state, when the housing 210 laterally traverses the blackboard plate 110, the left erasing means L traverses in the right direction in engagement with the blackboard plate 110.

Compared with FIG. 5*a*, the eccentric axles are rotated at a prescribed angle in the clockwise direction. However, a very important aspect is that as shown in FIG. 5*b*, though the right eccentric axle 221R and the left eccentric axle 221L are both rotated at the same angle, the left erasing means L is engaged more closely than the right erasing means R. The reason is described hereinafter.

In FIG. 5*a*, the displacement start point LA of the left eccentric axle 221L is located at a prescribed angle θ, for example, about between 14° to 18°, from its axis center line LY in the clockwise direction, and the displacement start point RA of the right eccentric axle 221R is located at a prescribed angle θ, for example, about between 14° to 18°, from its axis center line RY in the counterclockwise direction. It satisfies the following relationship.

$$LT=2\cdot Lt$$

Since the displacement start points RA and LA of the right and left eccentric axles 221R and 221L are located at different coordinates on the rotation route respectively, the left eccentric axle 221L has more displacement than the right eccentric axle 221R. Therefore, though the eccentric axles 221R and 221L both rotate at the same angle in clockwise direction, the left erasing means contacts the blackboard plate 110 relatively more closely than the right erasing means because of the displacement of the left eccentric axle 221L.

At this time, the maximum displacement by the rotation of the left eccentric axle 221L is $Ld_{max}$ and the minimum displacement by the rotation of the right eccentric axle 221R is $Rd_{min}$. In the left contact state, the right brush 230R is slightly or not at all in contact with the blackboard plate 110. Therefore, it satisfies the following relationship.

$$Rd_{min}\leq Rt$$

Because the left brush 230L must be completely in contact with the blackboard plate 110, and the left wiper members 240L must be in contact with the blackboard plate 110, the left contact state satisfies the following relationship.

$$2\cdot Lt<Ld_{max}<3\cdot Lt$$

FIG. 5*c* illustrates the right contact state of the erasing means. When the housing 210 returns to its original position, the right erasing means traverses in the left direction of the blackboard plate 110 and is in engagement with the blackboard plate 110.

The right eccentric axle 221R and the right erasing means are actuated by the same principle of the left eccentric axle 221L and the left erasing means as mentioned above. Therefore, the right contact state satisfies the following relationships.

$$RT=2\cdot Rt,$$

$$Ld_{min}\leq Lt, \text{ and}$$

$$2\cdot Rt<Rd_{max}<3-Rt$$

However, between the left contact state and the right contact state, the right and left eccentric axles 221R and 221L have opposite rotary directions to each other.

After erasing the blackboard plate 110, the erasing means is in the neutral state.

By the principles described above, the erasing means is either engaged or not engaged with the blackboard plate 110 according to the displacement of the eccentric axles 221R and 221L.

In this invention, the erasing means includes two pairs of the erasing means having one brush and two wiper members. However, it will be appreciated that other acceptable means of erasing may be used to erase the blackboard plate 110.

Figure 8A:
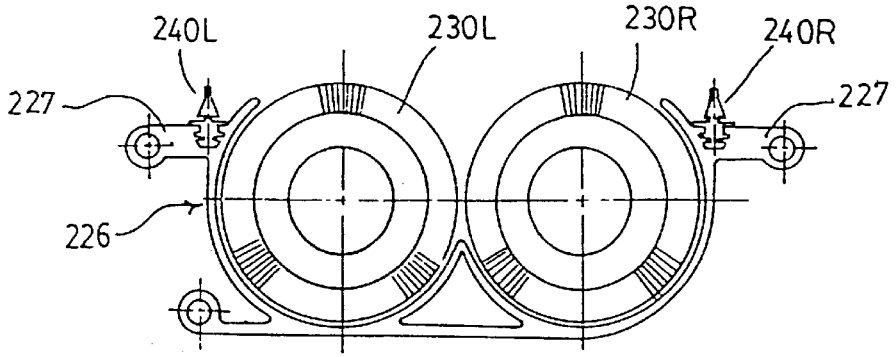
FIGS. 8*a* to 8*c* are plan views showing a modified embodiment of the brushes and the wiper members according to the present invention.
Figure 8B:
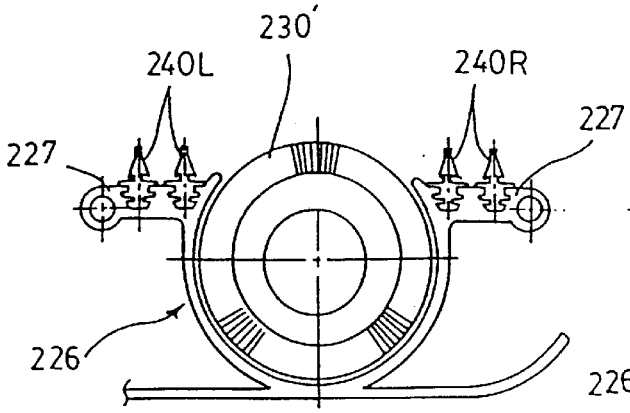
Figure 8C:
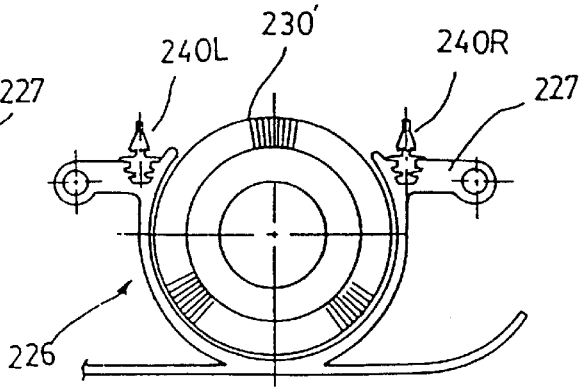

FIGS. 8*a* to 8*c* illustrate modified types of the erasing means.

In FIG. 8*a*, the erasing means has the same structure as the preferred embodiment of the present invention, but the erasing means of FIG. 8*a* is different from the erasing means of the preferred embodiment of the present invention in that each of the erasers has one brush and one wiper member.

In FIG. 8*b*, the erasing means has one brush and one or two pairs of wiper members positioned at right and left sides of the brush as pairs.

In FIG. 8*c*, the erasing means has one brush and two wiper members positioned at right and left sides of the brush one by one. The essential requirement is that the brush firstly erases the blackboard plate 110 and then the wiper member wipes the moistened blackboard plate 110, following the brush.

The washing liquid supplier 250 for supplying the washing liquid will now be briefly described as follows.

The washing liquid is supplied between the brushes 230R and 230L and the surface of the blackboard plate 110 by the washing liquid supplier 250 detachably mounted beneath the erasing device housing 210 (see FIG. 1). The washing liquid supplier 250 moves back and forth laterally over the blackboard plate 110 with the erasing device housing 210.

The washing liquid supplier 250 includes a tank 253 for storing the washing liquid, such as water or a surfactant, a pump 251 mounted in the tank 253 for providing the washing liquid by pump action, and a pipe 252 communicating with an outlet of the pump 251, upwardly transferring the washing liquid from the pump 251 and spraying the washing liquid between the brushes 230R and 230L, and the blackboard plate 110 engaging with the brushes 230R and 230L.

A filter 254 is detachably mounted within the tank 253 for filtering the used washing liquid.

The blackboard plate 110 which has been moistened by the washing liquid can be completely dried by a forced drier to provide the optimum conditions for use of the blackboard plate 110.

Figure 4:
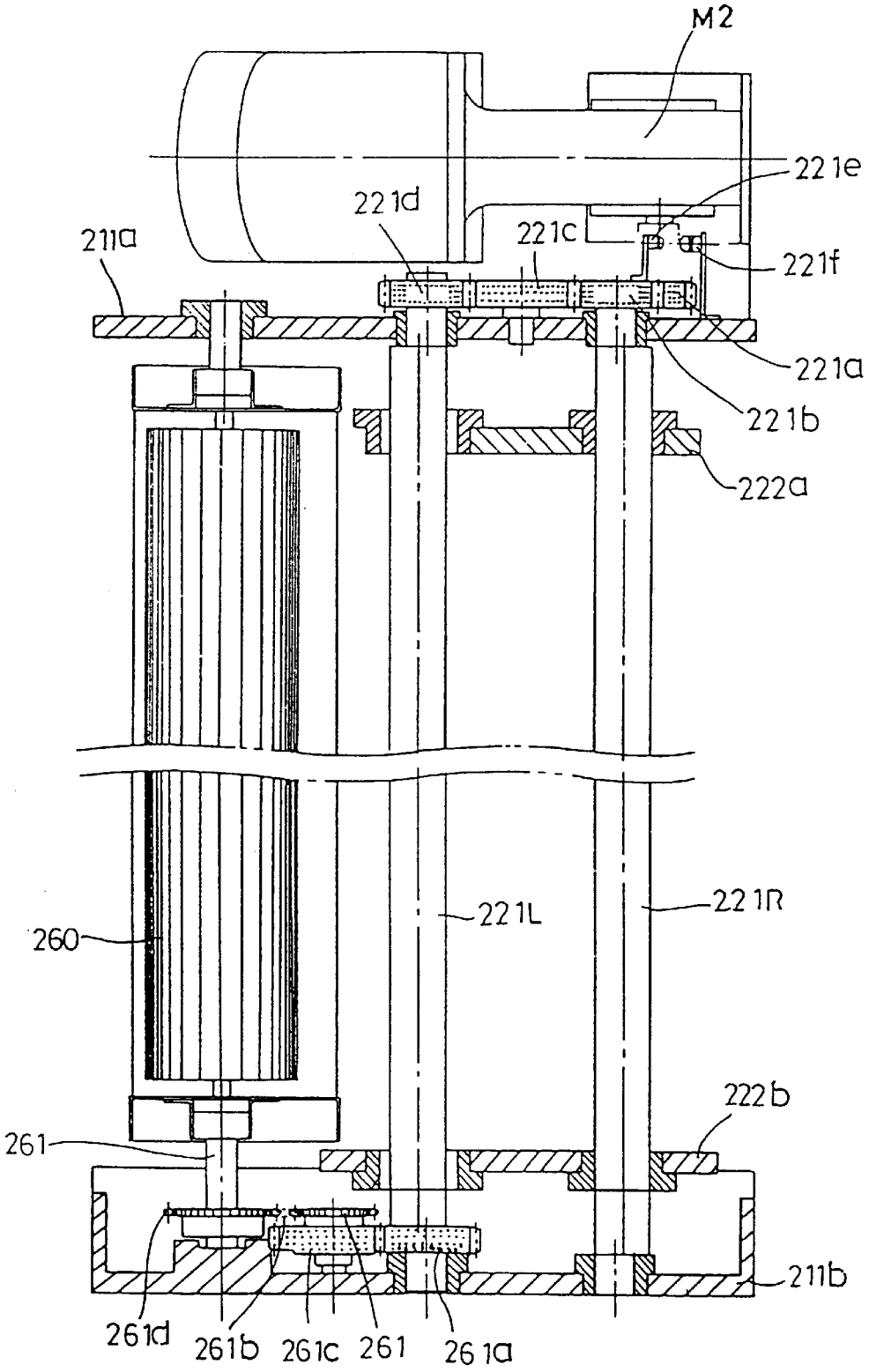
FIG. 4 is a vertical sectional view taken from the front direction against the variable contact means and a forced drier according to the preferred embodiment of the present invention.

Referring to FIGS. 3 and 4, the forced drier is described in detail.

In one embodiment, the forced drier is a fan heater 260 used in conjunction with a halogen lamp.

As shown in FIG. 4, a gear 261*a* which meshes with a pinion gear 261*b* is drivingly interconnected with the lower portion of the left eccentric axle 221L. The pinion gear 261*b* has a first sprocket 261*c* integrally formed thereon. The first sprocket 261*c* is wound by a roller chain 261*e* with a second sprocket 261*d* that is mounted on a lower shaft 261 of the fan heater 260, thereby transmitting the rotary power of the eccentric axle 221L to the fan heater 260 through the gears and the sprockets.

In the left contact state of the eraser, the fan heater 260 changes its position as follows.

When the left erasing means is in contact with the surface of the blackboard plate 110, the left eccentric axle 221L is rotated in the clockwise direction as previously described. Therefore, the gear 261*a* mounted on the lower portion of the left eccentric axle 221L is also rotated in the clockwise direction, and the pinion gear 261*b* meshed with the gear 261*a* is rotated in the counterclockwise direction. The first sprocket 261*c* integrally formed on the pinion gear 261*b,* and the second sprocket 261*d* connected with the first sprocket 261*c* by the roller chain 261*e,* are also rotated in the counterclockwise direction. The fan heater 260 drivingly interconnected with the second sprocket 261*d* is also rotated in the counterclockwise direction to direct a blast port of the fan heater 260 toward the left erasing means L, so that the fan heater 260 provides hot air to the blackboard plate 110 from the back of the left wiper members 240L.

When the left erasing means L traverses in the right direction of the blackboard plate 110 in engagement with the blackboard plate 110, the fan heater 260 also traverses in the right direction of the blackboard plate 110 to dry the surface of the blackboard plate 110 cleaned by the left erasing means L.

In the meantime, in the right contact state of the other eraser, when the left eccentric axle 221L rotates in the counterclockwise direction, the fan heater 260 is rotated in the clockwise direction. Therefore, the blast port of the fan heater 260 is directed to a blast passage positioned between a rear portion 226*c* of the second cover member 226 and a front portion 225*a* of the first cover member 225.

When the right erasing means R traverses in the left direction of the blackboard plate 110 in engagement with the blackboard plate 110, the fan heater 260 also traverses in the left direction of the blackboard plate 110, providing hot air at the back of the right side wiper members 240R through the blast passage to dry the surface of the moistened blackboard plate 110.

In this embodiment, the forced drier is the fan heater 260, but it will be appreciated that other equivalent types of the drying means can be used. For example, a fan ventilating only dry wind may be adopted in place of the fan heater, or instead of changing the position of the fan heater, two fan heaters may be respectively mounted on left and right sides of the erasing means so that the right fan heater is operated when the right erasing means R traverses in the left direction of the blackboard plate 110 in engagement with the blackboard plate 110, and the left fan heater is operated when the left erasing means L traverses in the right direction of the blackboard plate 110 in engagement with the blackboard plate 110.

Figure 7:
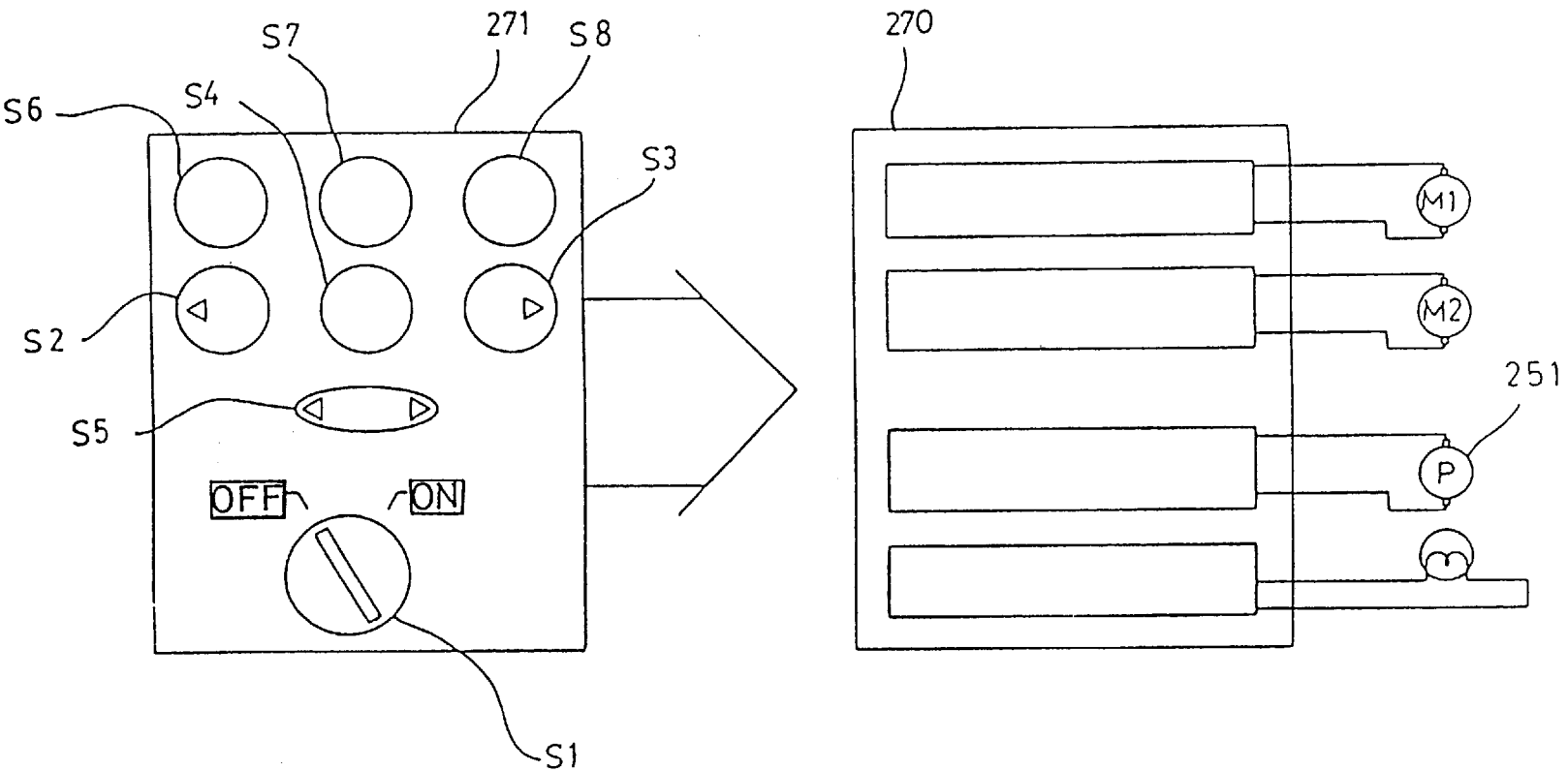
FIG. 7 is a plan view showing a controller and a P.C.B. circuit board for controlling the operation of the erasing apparatus according to the present invention.

The automatic erasing apparatus according to the present invention constructed as described above has a controller 271 for controlling the operation of the automatic erasing apparatus (see FIG. 7).

In FIG. 7, the character S1 indicates an on-off switch, S2 indicates a forward direction erase button, S3 indicates a backward direction erasion button, S4 indicates a stop button, S5 indicates a movement button, S6 indicates a high speed button, S7 indicates a hot air button, and S8 indicates a low speed button.

The controller 271 is electrically connected to a P.C.B circuit board 270 including circuits for actuating each of the motors M1 and M2, the washing liquid supplier 250, and the forced drier. By actuation of the controller 271, values being set on the P.C.B circuit board 270 are transferred to the motors M1 and M2, so that rotation numbers of the motors M1 and M2 may be variously output according to the set values.

By actuation of the buttons S2, S3, S4, or S5, the automatic erasing apparatus can erase only selected portions of the blackboard plate 110 or the entire surface of the blackboard plate 110.

In dry weather, since natural drying effects are high, the movement of the housing 210 with the forced drier may be fast without having to operate the forced drier, but in humid weather, it is desirable that the housing 210 with the forced drier traverse slowly while the forced drier is actuated and controlled by pressing the buttons S2, S3, S7, and/or S8 to completely dry the blackboard plate 110. Therefore, by controlling the rotation speed of the motors M1 and M2 and the operation of the forced drier, depending on the weather, the blackboard plate 110 is maintained at optimum conditions for use.

In FIGS. 9*a* to 17, other preferred embodiments of this invention are illustrated. The reference numerals designating corresponding parts are the same as the previously described first embodiment of the present invention.

Figure 9:
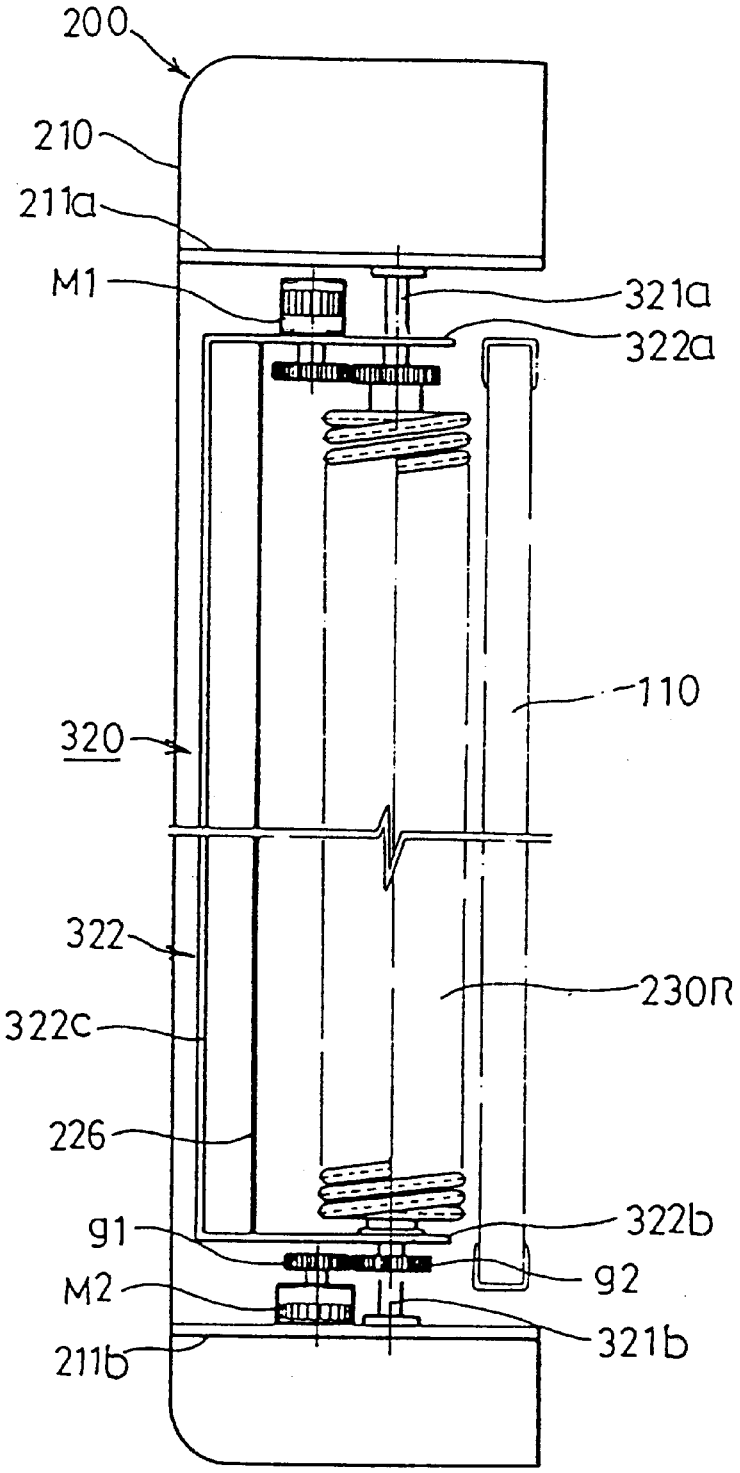
FIG. 9 is a vertical sectional view taken from the right direction against variable contact means of an erasing apparatus according to another preferred embodiment of the present invention.
Figure 10B:
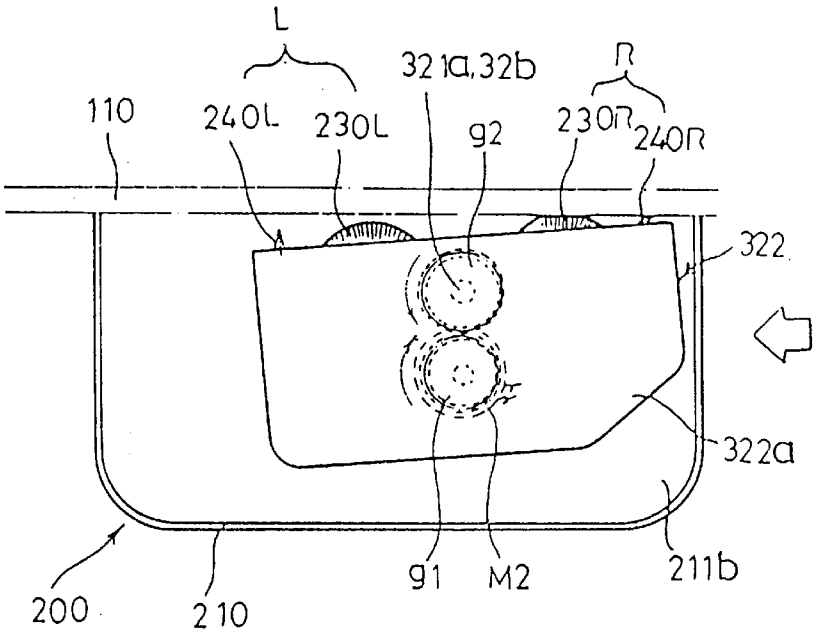
FIGS. 10*a* and 10*b* are plan views showing the operating state of the variable contact means of FIG. 9.

FIGS. 9 to 10*b* illustrate a second embodiment of the present invention.

In this embodiment, the drive motor M2 for rotating the variable contact means is a multistage split electric drive such as a stepping motor or oscillation motor.

Referring to FIG. 9, the variable contact means 320 includes: upper and lower hinge shafts 321*a* and 321*b* rotatably mounted on the upper and lower support plates 211*a* and 211*b* of the housing 200; a rotary body 322 having an upper plate 322*a* on which the upper hinge shaft 321*a* is fixed; a lower plate 322*b* on which the lower hinge shaft 321*b* is fixed; and a rear plate 322*c* extending between the upper plate 322*a* and the lower plate 322*b;* a first motor M1 mounted on the upper plate 322*a* and rotating the brushes; and a second motor M2 mounted on the lower support plate 211*b* and rotating the rotary body 322 by a gear g1 and a pinion gear g2 drivingly interconnected with the motor M2. The other components are the same as the first embodiment previously described.

The right and left brushes R and L covered by the second cover member 226 are rotatably mounted between the upper plate 322*a* and the lower plate 322*b* of the rotary body 322. By the shafts 321*a* and 321*b* rotatably mounted on the same axis with the brushes, the rotary body 322 is suitably mounted on the upper and lower support plates 211*a* and 211*b*.

Figure 10A:
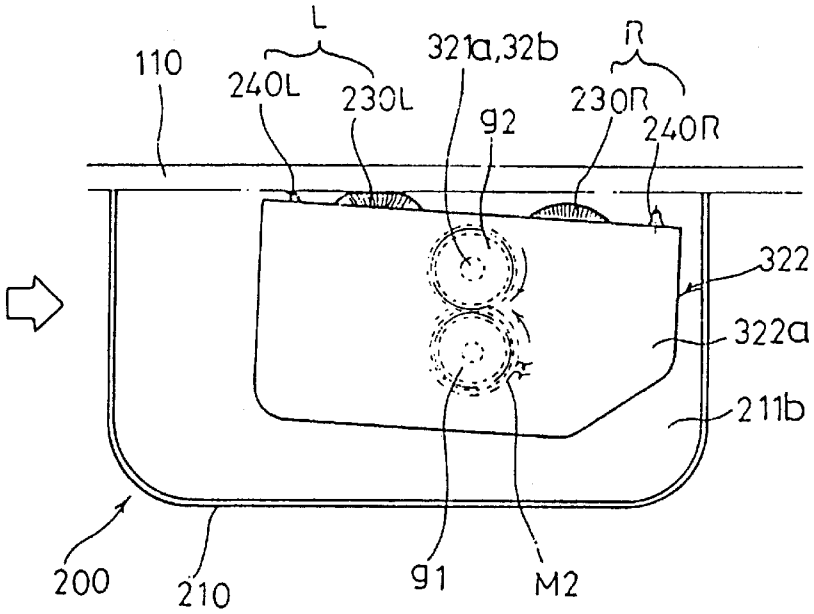

The second motor M2 for controlling the rotation of the rotary body 322 has a prescribed rotation angle. When the second motor $M_2$ rotates in the counterclockwise direction as shown in FIG. 10*a* the pinion gear g2 and the shaft 321*b* are rotated in the clockwise direction so that the left erasing means L is in contact with the blackboard plate 110. Contrary to the above, when the second motor M2 rotates in the clockwise direction as shown in FIG. 10*b,* the pinion gear g2 and the shaft 321*b* are rotated in the counterclockwise direction to rotate the rotary body 322 in the counterclockwise direction, so that the right erasing means R is contacted to the blackboard plate 330.

FIGS. 11 to 13*b* illustrate a third preferred embodiment of the present invention.

In this embodiment a wire and a spring are used for rotation of the variable contact means 420.

Figure 11:
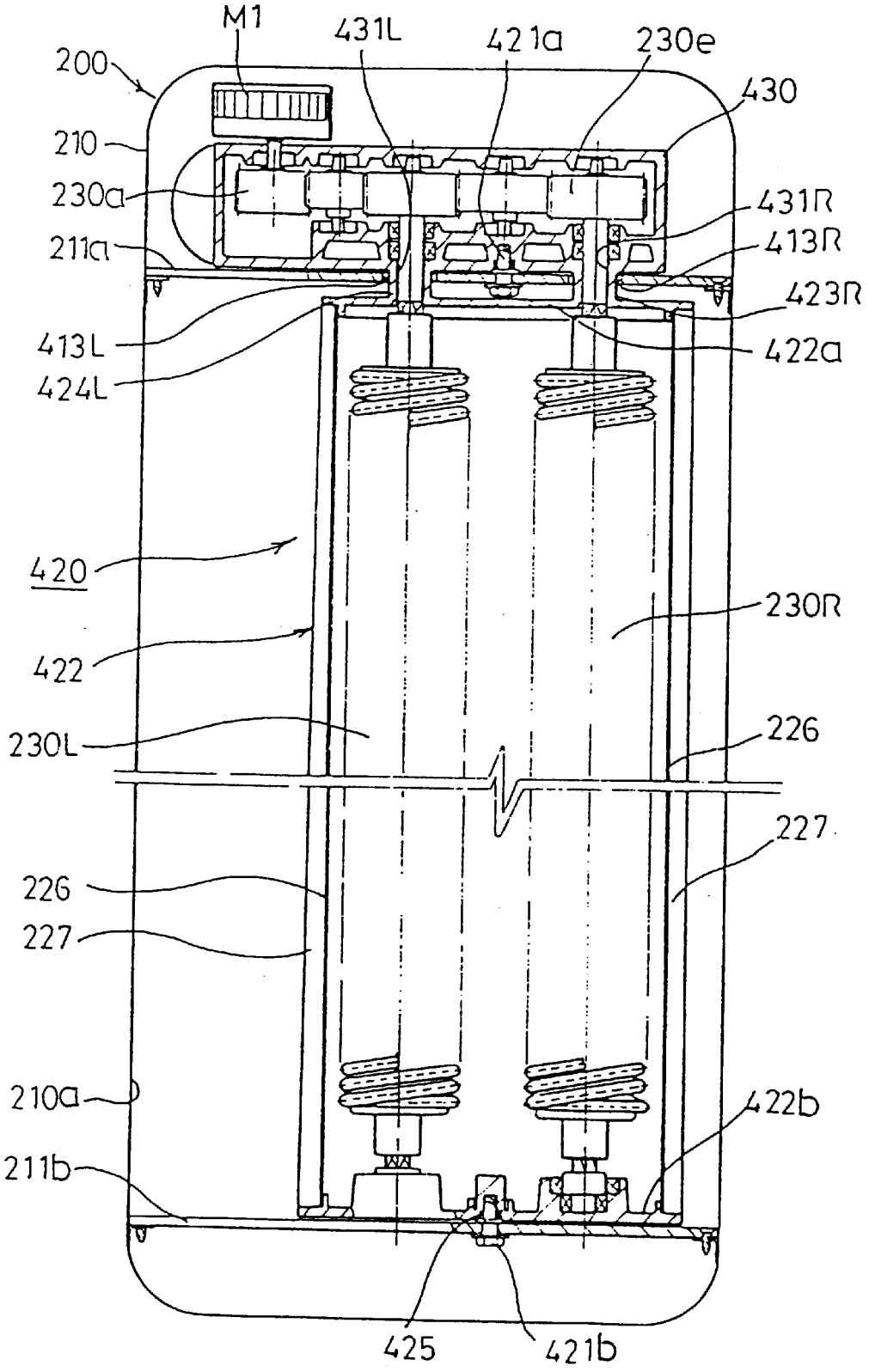
FIG. 11 is a vertical sectional view taken from the front direction against variable contact means of an erasing apparatus according to a further preferred embodiment of the present invention.
Figure 12:
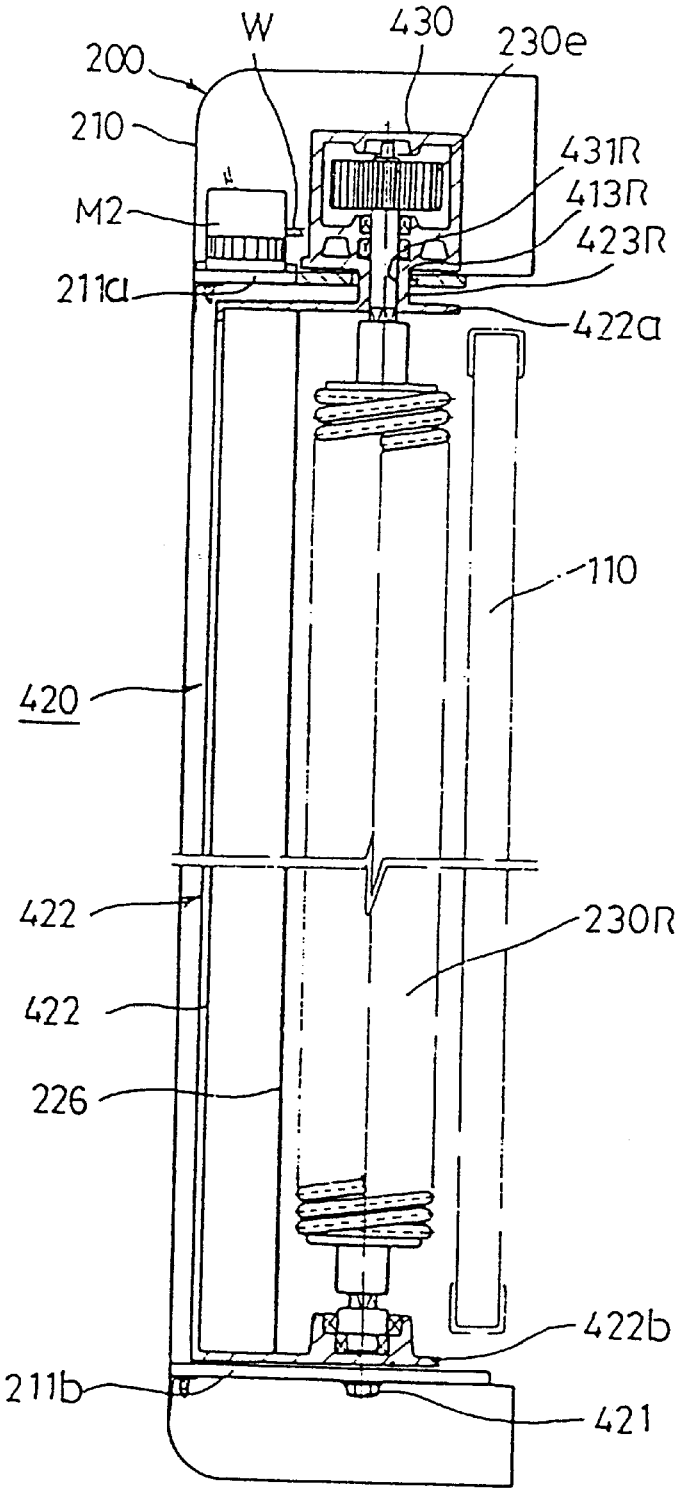
FIG. 12 is a vertical sectional view taken from right direction against the variable contact means of FIG. 11.

Referring to FIG. 11, the variable contact means 420 includes a gear case 430 rotatably mounted on the upper support plate 211*a* by an upper hinge pin 421*a* fixed on the upper support plate 211*a* and having right and left shafts 431R and 431L at a lower portion of the gears 230*c* arid 230*e* therein; a rotary body 422 formed integrally with the gear case 430 and having an upper plate 422*a* having two cylindrical connecting portions 423R and 423L connected integrally with the gear case 430; a lower plate 422*b* rotatably mounted on the lower support plate 211*b* by a lower hinge pin 421*b* fixed on the lower support plate 211*b;* and a rear plate 422*c* extending between the upper plate 422*a* and the lower plate 422*b*.

The hinge pins 421*a* and 421*b* are positioned at the same rotation axis and are respectively supported by bearings 425. The shafts 431R and 431L penetrate through right and left holes 413R and 413L formed on the upper support plate 211*a* and are drivingly interconnected with the brushes 230R and 230L.

Figure 13A:
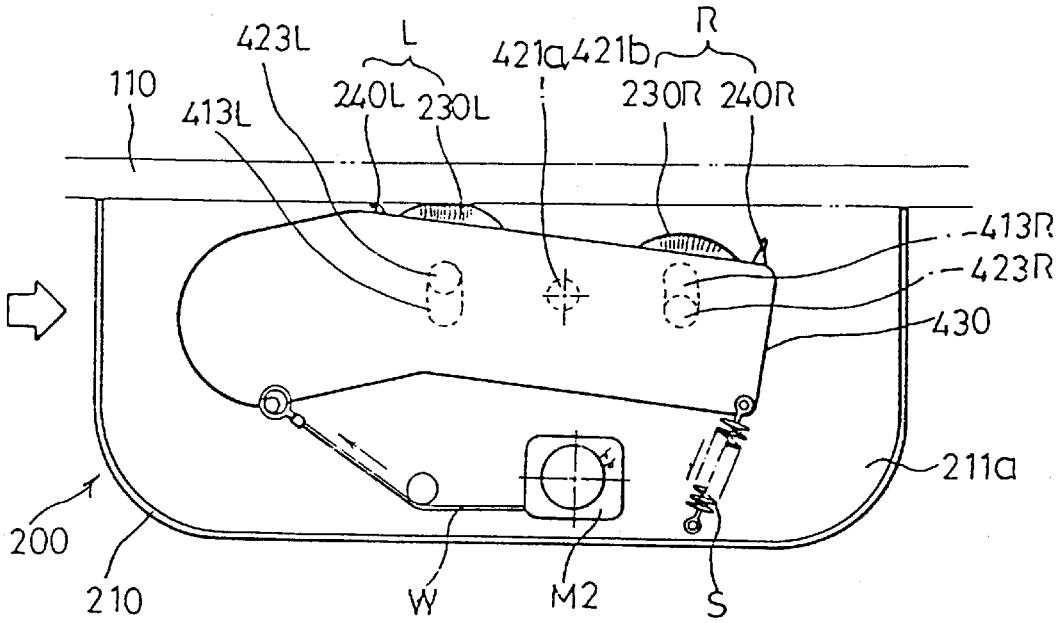
FIGS. 13*a* and 13*b* are plan views showing the operating state of the variable contact means of FIG. 11.
Figure 13B:
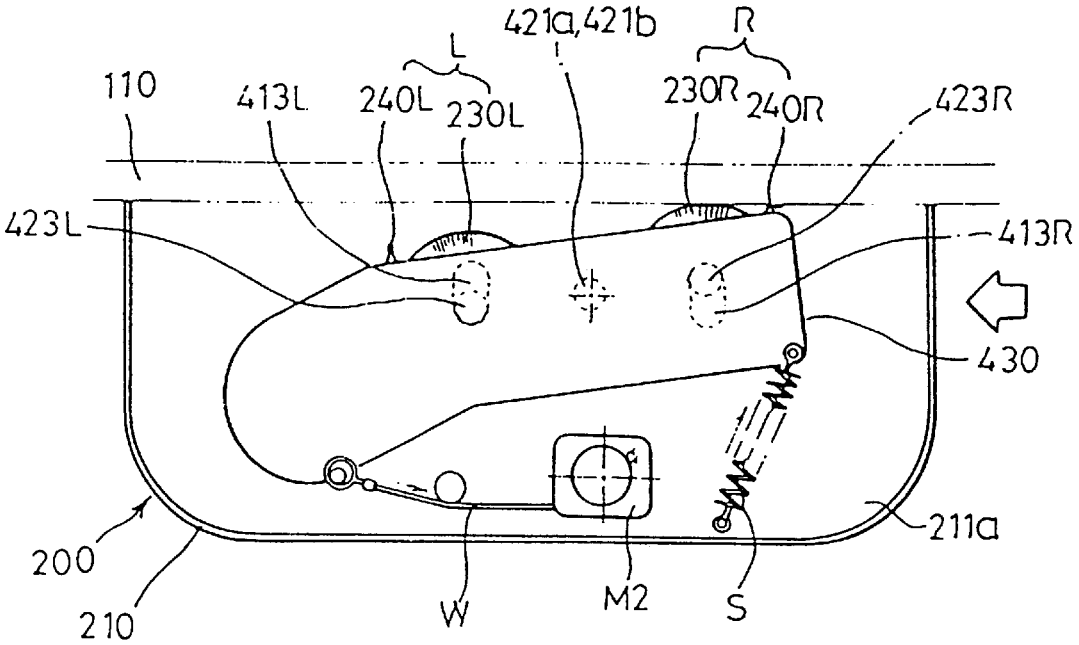

As shown in FIGS. 13*a* and 13*b,* an end of the wire W is coiled around the second motor M2 located on the upper support plate 211*a,* and the other end of the wire W is fixed to an end portion of the gear case 430. The spring S is fixed between the other end portion of the gear case 430 and a portion of the housing 210. Therefore, when the wire W is loosened by the rotation of the second motor M2, the gear case 430 and the rotary body 420 are rotated on the rotation axis at a prescribed angle in the clockwise direction, and the left erasing means L are in contact with the blackboard plate 110. At this time the spring S is contracted.

Contrary to the above, when the wire W is wound on the second motor M2, the spring S is extended, and then the gear case 430 and the rotary body 420 are rotated on the rotation axis at a prescribed angle in the counterclockwise direction. The right erasing means R are thus in contact with the blackboard plate 110.

FIGS. 14 to 16*b* illustrate a fourth preferred embodiment of the present invention.

In this embodiment, the drive motor M2 for rotating the variable contact means is also a multistage split electric drive such as a stepping motor or oscillation motor to supply drive power to this automatic erasing device.

The difference from the third embodiment previously described is that the gear case has a protrusion on an upper portion thereof.

Figure 14:
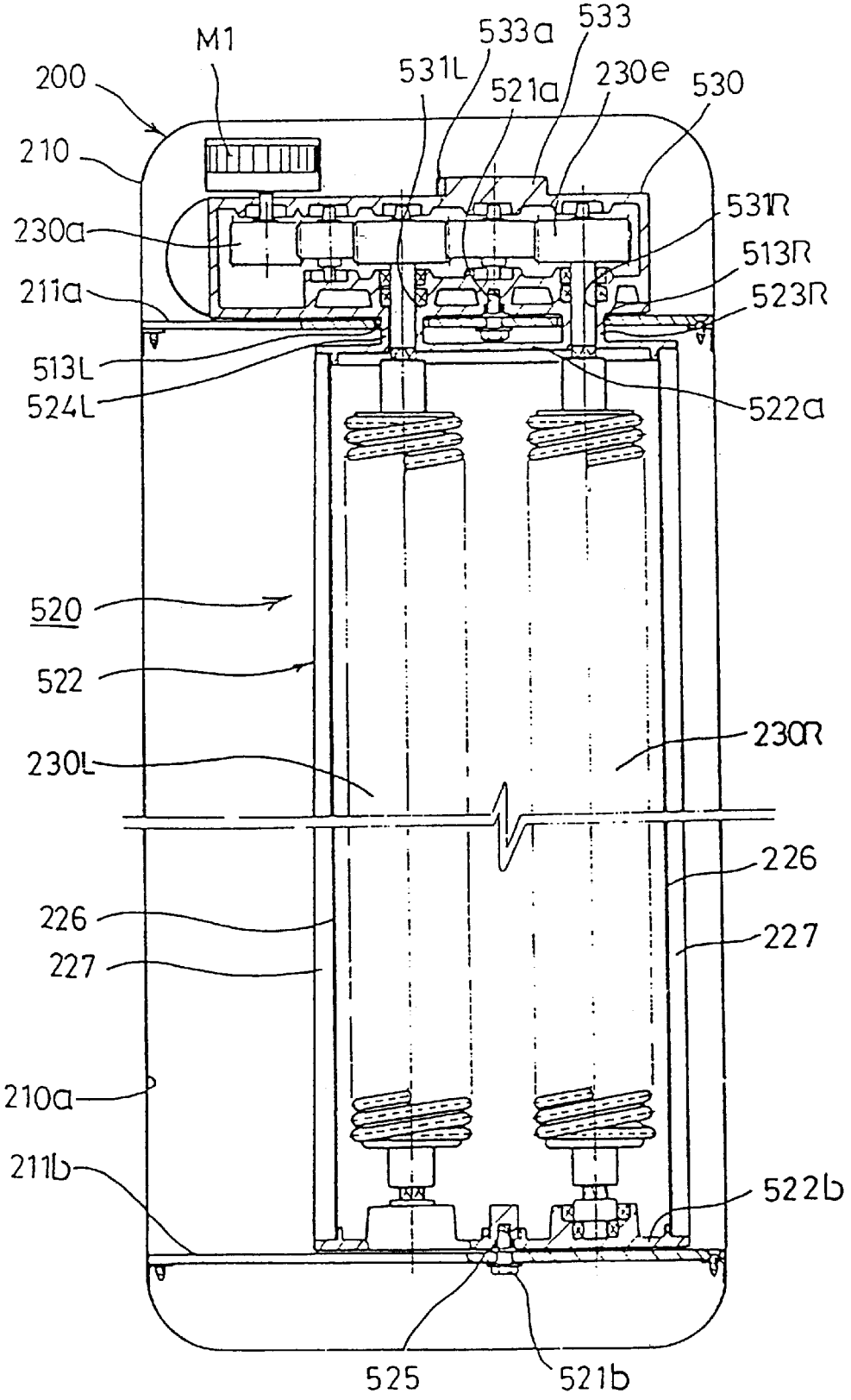
FIG. 14 is a vertical sectional view taken from the front direction against variable contact means of an erasing apparatus according to still another preferred embodiment of the present invention.
Figure 15:
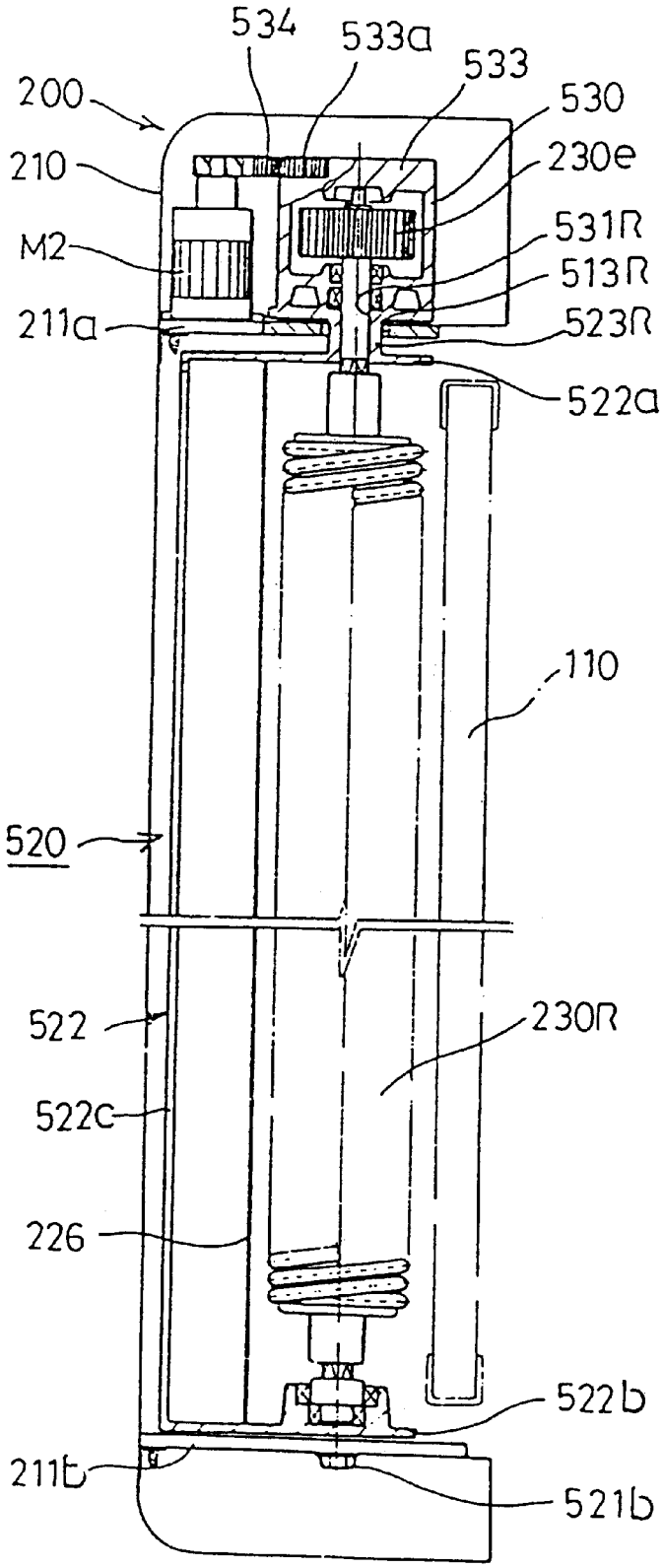
FIG. 15 is a vertical sectional view taken from the right direction against the variable contact means of FIG. 14.

Referring to FIGS. 14 and 15, the variable contact means 520 includes: a gear case 530 rotatably mounted on the upper support plate 211*a* by an upper hinge pin 521*a* fixed on the upper support plate 211*a* and having right and left shafts 531R and 531L at lower portions of the gears 230*c* and 230*e* therein; a rotary body 522 formed integrally with the gear case 530 and having an upper plate 522*a* having two cylindrical connecting portions 523R and 523L connected integrally with the gear case 530; a lower plate 522*b* rotatably mounted on the lower support plate 211*b* by a lower hinge pin 521*b* fixed on the lower support plate 211*b;* and a rear plate 522*c* extending between the upper plate 422*a* and the lower plate 522*b*.

The hinge pins 521*a* and 521*b* are positioned at the same rotation axis and are respectively supported by bearings 525. The shafts 531R and 531L penetrate through right and left holes 513 R and 513L formed on the upper support plate 211*a* and are drivingly interconnected with the brushes 230R and 230L.

The gear case 530 has a protrusion 533 on the upper portion thereof. The protrusion 533 has a tooth-shaped portion 533*a* at a front portion thereof. The tooth-shaped portion 533*a* of the protrusion 533 is engaged with a sectored gear 534 drivingly interconnected with the drive motor M2. Thickness of the housing 210 may be reduced by the sectored gear 534.

Figure 16A:
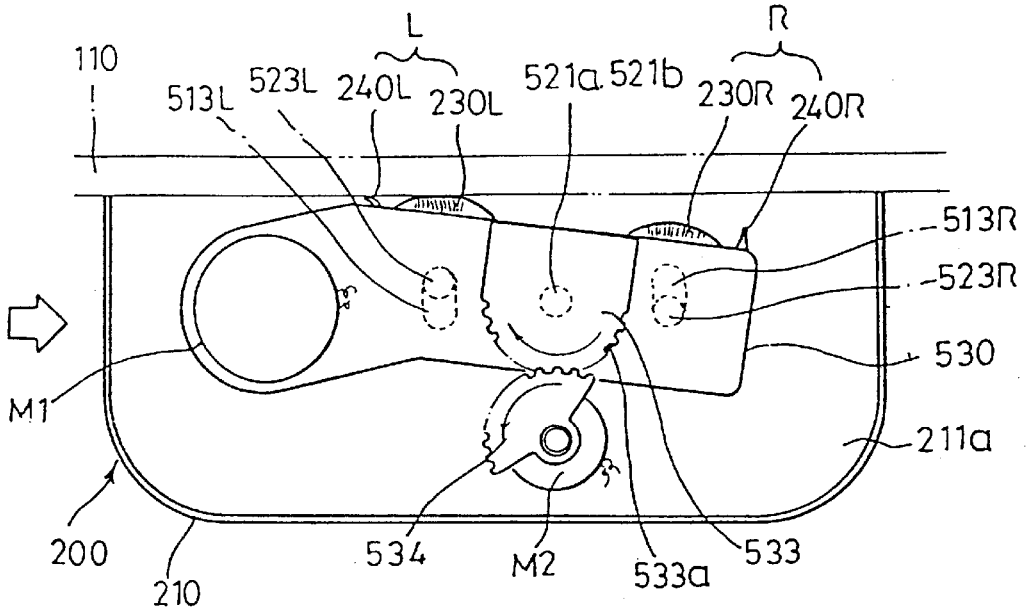
FIGS. 16*a* and 16*b* are plan views showing the operating state of the variable contact means of FIG. 14.
Figure 16B:
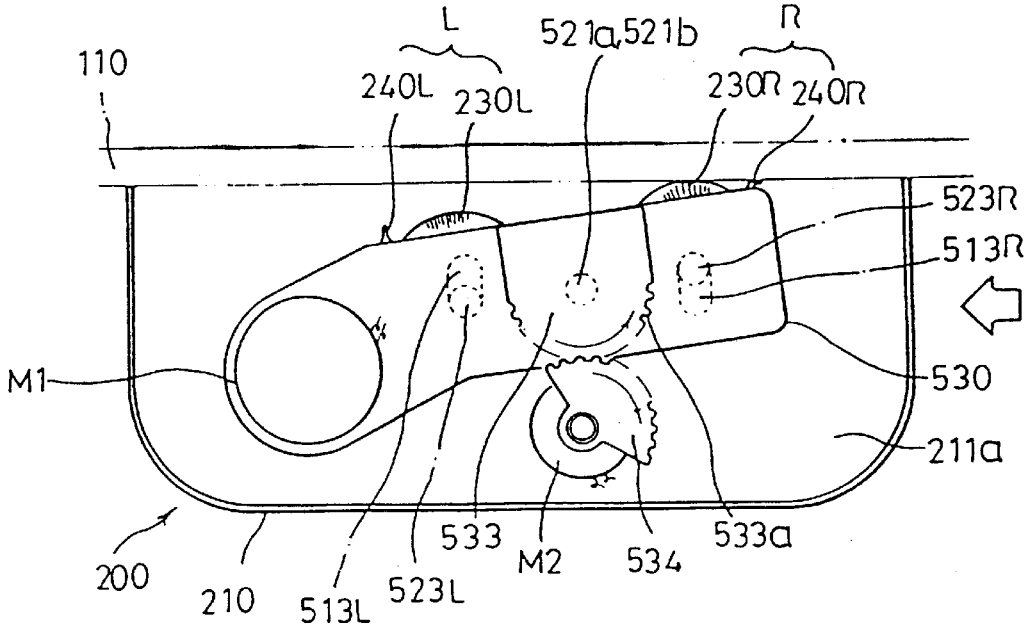

As shown in FIGS. 16*a* and 16*b,* when the second motor M2 and the sectored gear 534 rotate at a prescribed angle in the counterclockwise direction, the tooth-shaped portion 533*a* of the protrusion 533 is rotated in the clockwise direction, and then the gear case 530 and the rotary body 520 are also rotated in the clockwise direction to allow the left erasing means L to be in contact with the blackboard plate 110.

Contrary to the above, when the second motor M2 and the sectored gear 534 rotate in the clockwise direction, the tooth-shaped portion 533*a* of the protrusion 533 is rotated in the counterclockwise direction, and then the gear case 530 and the rotary body 520 are also rotated in the counterclockwise direction to allow the right erasing means R to be in contact with the blackboard plate 110.

It will be appreciated that modifications may be made in this invention.

Figure 17:
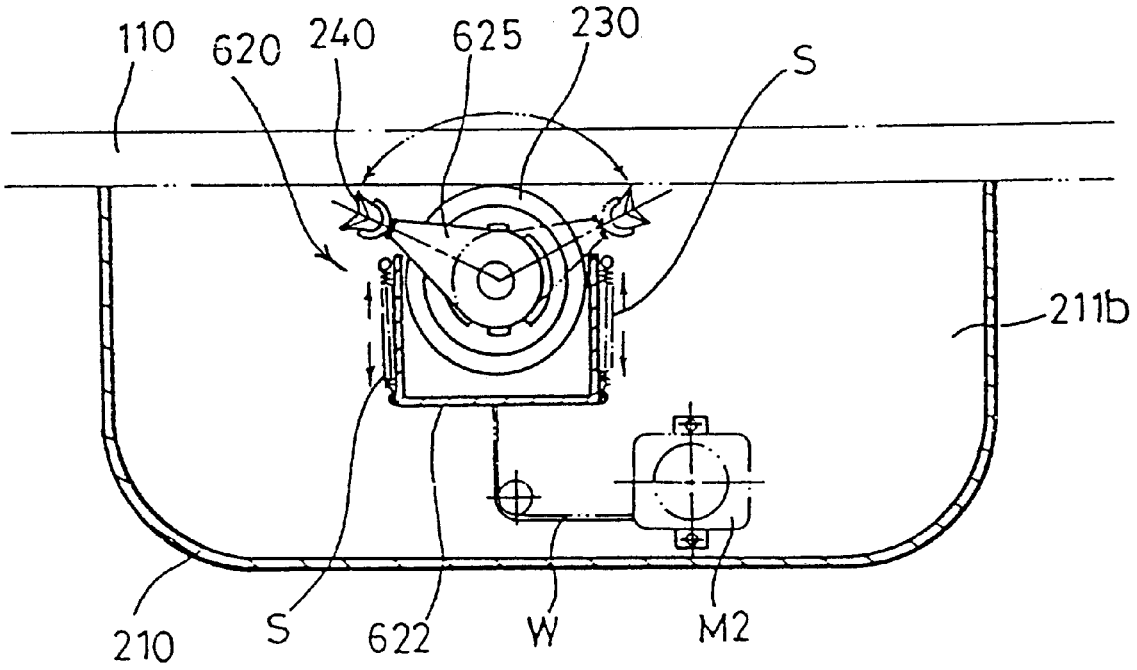
FIG. 17 is a plan view showing a modified embodiment of the variable contact means according to the present invention.

FIG. 17 illustrates a modified embodiment of the erasing means and the variable contact means. The previously described preferred embodiments have two pairs of erasers having one brush and one or two wiper members respectively, while the modified embodiment has one brush and one wiper member.

In this modified embodiment, the upper and lower support plates 211*a* and 211*b* have an elongated hole respectively (not shown in the drawing). Through the elongated hole of the upper and lower support plate 211*a* and 211*b,* a slide body 622 in which the brush 230 is rotatably mounted may move in a forward or backward direction against the blackboard plate 110. In FIG. 17, the reference numeral 625 indicates a rotatable link member. The wiper member 240 can be positioned on right side or left side of the brush 230 by the rotatable link member 625.

The modified variable contact means 620 is operated as follows.

Referring to FIG. 17, when the second motor M2 winds the wire W, the slide body 622 moves backwardly along the elongated hole of the upper and lower support plate 211*a* and 211*b* so that the brush is not in contact with the blackboard plate 110, while springs S, which are respectively mounted between the upper and lower portions of the slide body 622 and the upper and lower support plates 211*a* and 211*b,* are extended. At this time, the wiper member 240 is rotated on right side or left side of the brush 230 by the link member 625. In order to erase the blackboard plate 110, when the second motor M2 loosens the wire W, the slide body 622 is moved in a forward direction against the blackboard plate 110 by elasticity of the springs S so that the brush 230 and the wiper member 240 are in contact with the blackboard plate 110. Therefore, this modified embodiment can also provide almost the same effect as the previously described embodiments of this invention.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. An apparatus for automatically erasing a blackboard, the blackboard erasing apparatus comprising:

a housing having an opening toward a blackboard plate, an upper support plate and a lower support plate which are fixed to walls of the housing;

variable contact means having right and left eccentric axles rotatably mounted between the upper support plate and the lower support plate, an upper rectangular variable plate having a round hole through which the right eccentric axle protrudes, a lower rectangular variable plate having an elliptical hole through which the left eccentric axle protrudes, a first cover member vertically mounted between the upper variable plate and the lower variable plate and covering the eccentric axles, and a second cover member vertically mounted between the upper variable plate and the lower variable plate, the second cover member having two protrusions protruded outwardly from both front end portions of the second cover member;

right erasing means having a right cylindrical brush and two right wiper members; and left erasing means having a left cylindrical brush and two left wiper members, the brushes rotatably mounted between the upper and lower variable plates and positioned within the second cover member, the wiper members being formed in a wedge shape and positioned within the protrusions of the second cover member.

2. An apparatus for automatically erasing a blackboard, the blackboard erasing apparatus comprising:

a housing having an opening toward a blackboard plate, an upper support plate and a lower support plate which are fixed to walls of the housing;

variable contact means having right and left eccentric axles rotatably mounted between the upper support plate and the lower support plate, an upper rectangular variable plate having a round hole through which the right eccentric axle protrudes, a lower rectangular variable plate having an elliptical hole through which the left eccentric axle protrudes, a first cover member vertically mounted between the upper variable plate and the lower variable plate and covering the eccentric axles, and a second cover member vertically mounted between the upper variable plate and the lower variable plate, the second cover member having two protrusions protruded outwardly from both front end portions of the second cover member;

right erasing means having a right cylindrical brush and a right wiper member; and left erasing means having a left cylindrical brush and a left wiper member, the brushes rotatably mounted between the upper and lower variable plates and positioned within the second cover member, the wiper members being formed in a wedge shape and positioned within the protrusions of the second cover member.

3. An automatic blackboard erasing apparatus according to one of claims 1 to 2, wherein the second cover member fixed to the variable contact means is formed so as to surround at least one of the cylindrical brushes along an outside cylindrical periphery of the brushes except where the brushes face the blackboard.

4. An automatic blackboard erasing apparatus according to one of claims 1 to 2, wherein the erasing apparatus further comprises a washing liquid supplier having a tank for storing the washing liquid, a pump mounted in the tank for providing the washing liquid by pump action, and a pipe communicating with an outlet of the pump, to upwardly transfer the washing liquid from the pump and to spray the washing liquid between the brushes and the blackboard plate engaging with the brushes.

5. An automatic blackboard erasing apparatus according to one of claims 1 to 2, wherein the erasing apparatus further comprises a fan heater rotatably mounted between the upper and lower support plates of the housing.

6. An automatic blackboard erasing apparatus according to one of claims 1 to 2, wherein the wiper members are made of rubber material and are coated with a thin film made of synthetic resin polymer.

7. An automatic blackboard erasing apparatus according to claim 4, wherein the second cover member fixed to the variable contact means is formed so as to surround at least one of the cylindrical brushes along an outside cylindrical periphery of the brushes except where the brushes face the blackboard.

8. An automatic blackboard erasing apparatus according to claim 5, wherein the second cover member fixed to the variable contact means is formed so as to surround at least one of the cylindrical brushes along an outside cylindrical periphery of the brushes except where the brushes face the blackboard.

9. An automatic blackboard erasing apparatus according to claim 6, wherein the second cover member fixed to the variable contact means is formed so as to surround at least one of the cylindrical brushes along an outside cylindrical periphery of the brushes except where the brushes face the blackboard.

* * * * *